United States Patent [19]

Rhen

[11] Patent Number: 4,846,358

[45] Date of Patent: Jul. 11, 1989

[54] DRAFT GEAR FOLLOWER FENDER

[75] Inventor: Dennis Rhen, McMurray, Pa.

[73] Assignee: A. Stucki Company, Pittsburgh, Pa.

[21] Appl. No.: 14,660

[22] Filed: Feb. 13, 1987

[51] Int. Cl.[4] ..... B61G 9/16

[52] U.S. Cl. ..... 213/64; 213/72

[58] Field of Search ..... 213/62 R, 64, 69, 72

[56] References Cited

U.S. PATENT DOCUMENTS

| | | | |
|---|---|---|---|
| 497,777 | 5/1893 | Ellis | 213/45 |
| 1,199,167 | 9/1916 | Ewing | 213/8 |
| 1,213,924 | 1/1917 | McAlister | 213/40 |
| 1,222,118 | 4/1917 | Miner | 213/40 |
| 1,228,216 | 5/1917 | Kadel | 213/72 |
| 1,589,388 | 6/1926 | Haseltine | 213/69 |
| 1,609,166 | 11/1926 | Haseltine | 213/61 |
| 1,648,339 | 11/1927 | George, Jr. | 213/72 |
| 2,212,843 | 8/1940 | Metzger | 213/64 |
| 2,318,472 | 5/1943 | Dwyer, Jr. et al. | 213/40 |
| 2,815,865 | 12/1957 | Pelikan | 213/61 |
| 2,889,940 | 6/1959 | Metzger | 213/69 |
| 3,400,834 | 9/1968 | Zanow | 213/64 |
| 3,760,954 | 9/1973 | Hershey et al. | 213/69 |
| 3,788,493 | 1/1974 | Hawthorne et al. | 213/20 |
| 3,827,575 | 8/1974 | Mosier et al. | 213/8 |
| 3,836,013 | 9/1974 | Hawthorne | 213/54 |
| 3,840,126 | 10/1974 | Domer | 213/45 |
| 4,120,404 | 10/1978 | Chierici et al. | 213/62 R |

FOREIGN PATENT DOCUMENTS

| | | |
|---|---|---|
| 207704 | 4/1957 | Australia . |
| 620181 | 5/1961 | Canada . |

*Primary Examiner*—Joseph F. Peters, Jr.
*Assistant Examiner*—Edwin L. Swinehart
*Attorney, Agent, or Firm*—Carothers & Carothers

[57] ABSTRACT

A resiliently deformable fender for controlling transverse movement of a railway vehicle draft gear follower block and for cushioning engagement between the follower block and the center sill of a railway car body.

14 Claims, 3 Drawing Sheets

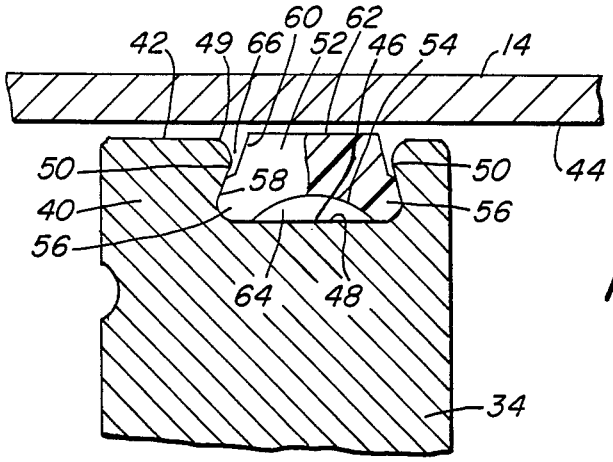
FIG. 3
FIG. 2
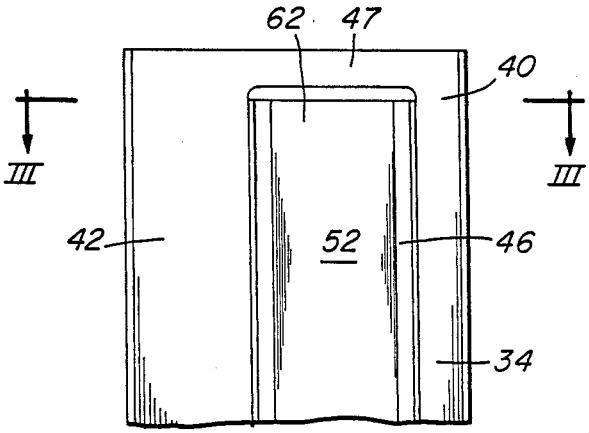
FIG. 4
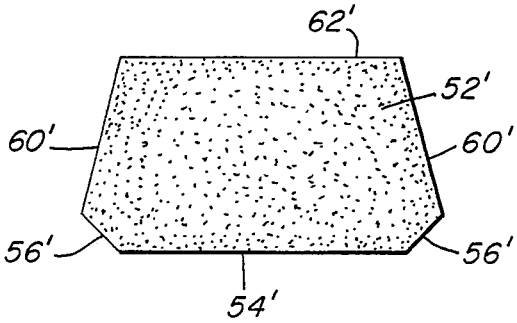

DRAFT GEAR FOLLOWER FENDER

BACKGROUND OF THE INVENTION

It is well known in the art of railway rolling stock that the phenomenon known as "train action" occurs more or less continuously throughout the length of a moving train of railway cars. Train action results when relative acceleration and deceleration between adjacent cars in the train subjects the draft gear and coupler assemblies at the ends of each car to short longitudinal motion cycles between fully extended and fully compressed limits. Typical friction draft gear assemblies generally will accommodate 2-¾ inches to b 4-½ inches of longitudinal travel from no load to the extreme buff or compression condition or from no load to the extreme draft or tension condition for a total coupler travel of 5-½ inches to 9 inches. This relative motion occurs continuously between adjacent railway cars as the respective couplers and draft gears respond to the relative accelerations and decelerations of the cars.

In general, such relative accelerations and decelerations between adjacent cars can occur at any point in a moving train; however, perhaps the most common and conspicuous example of train action is the transmission of a starting or a braking impulse from the locomotive in rapid sequence through the length of the train. Train action thus occurs when a train is accelerating from a dead stop in either the forward or reverse direction, decending a downgrade or passing from a downgrade to an upgrade, for example.

When the longitudinal coupler forces between two railway cars approach zero, the draft gears in each of the respective couplers extend to their fully extended limit under the bias of the longitudinal spring elements incorporated therein. The subsequent application of longitudinal force to the car couplers, either in tension (draft) or compression (buff), tends to overcome the extension bias of the draft gear spring elements. With application of buff or draft loads of sufficient magnitude, the draft gears will be compressed to the limits of longitudinal motion imposed by the draft gear structure.

When moving from a buff or compression condition to a draft or tension condition each affected draft gear experiences a complete motion cycle, moving from a state of compression to extension, to compression again. Similarly, for every complete force cycle between adjacent cars from buff loading to draft loading to buff loading again, both of the affected draft gears undergo two complete motion cycles. The compression-to-extension-to-compression cycle is completed once as the cars move from a buff to a draft condition, and a second such cycle is completed as the cars are returned from draft condition to the buff condition.

As can be seen, the relative acceleration and deceleration between the cars of a train results in considerable relative longitudinal movement of the draft gear and coupler components, all of which are subject to wear as a result of such relative movement. In particular, a draft gear assembly commonly includes a coupler follower block located intermediate the coupler and the draft gear. The coupler follower block transmits buff loads from the coupler directly to the draft gear while coupler tension forces are transmitted in the well known manner from the coupler to the yoke to the draft gear and finally via the coupler follower block to the draft sill stops. Thus, the coupler follower block is substantially continuously lodged against the draft sill stops when the coupled cars are in draft, or when the longitudinal force between them is nil. However, when the coupler forces between adjacent cars change from nil to a draft condition and back to nil, the draft gear yoke moves longitudinally with respect to the stationary follower block as the draft gear first compresses and then re-extends.

The follower block also experiences a complete longitudinal motion cycle whenever the coupler forces go from nil to buff. In response to buff loading, the follower block moves with respect to the center sill throughout a range of motion dictated by the range of draft gear compression from its extended condition. For coupler forces approaching an extreme buff condition, the follower block moves longitudinally with respect to the center sill to its motion limit which is dictated by the solid compressed condition of the draft gear. During the range of coupler forces from extreme buff to nil, the draft gear re-extends to its free state thus moving the follower block longitudinally with respect to the center sill to the limit defined by engagement thereof with the draft sill stops.

Of course, as the coupling assemblies for railway cars are not produced to close tolerances, there is always the potential for misalignment of coupler and draft gear assembly elements. Furthermore, there is always the potential for misalignment between adjacent cars or the couplings thereof in a train. For example, when traversing a lateral track curve the adjacent cars of a train are necessarily misaligned and the draft or buff forces between the cars therefore also are out of alignment with the center sill and coupling system center line. Thus, there is considerable free play in known coupling components, especially transverse free play, and this is aggravated over time by progressive wear of the coupling components. As a result, misalignment of draft and coupling components may arise quite readily even when a train is travelling on tangent track rather than negotiating a curve. Since the draft and buff forces which are commonly imposed on the draft gear and coupling components of a railway car may exceed one million pounds, even very small magnitudes of longitudinal misalignment may result in transverse force components of considerable magnitude on draft and coupler elements.

As will be appreciated from the above, during changes in magnitude and/or direction of car coupling forces, there is continuing relative motion between the coupler follower block, center sill, and yoke surfaces in a draft gear assembly. Due to the inevitable misalignment as above described, the draft and buff coupling forces often may be misaligned with the longitudinal center line of the car couplings. Hence, transverse force components may be imposed upon the relatively longitudinally movable elements, most notably the follower block, and this can lead to undue wear resulting from considerable frictional rubbing between the relatively longitudinally moving members under the applied tranverse load components.

There have been prior attempts to alleviate this wear condition, including attempts to line the inner sidewall surfaces of the center sill with a liner material. This approach has thus far proven to be unsatisfactory as the longitudinal scraping of the follower block along the center sill sidewalls under significant transverse loads destroys the liner very quickly in service.

BRIEF SUMMARY OF THE INVENTION

The present invention contemplates a novel and improved method and apparatus for providing reduced levels of impact and wear between draft gear follower block and the transversely adjacent members. According to a preferred embodiment of the invention, a draft gear follower block is provided with an outwardly open recess or cavity means extending along opposed lateral sides thereof in confronting relationship with the inner sidewalls of the respective center sill of a railway car body, and similar upper and lower recesses or cavities in confronting relationship with the adjacent upper and lower surfaces of the yoke member. Each of the recesses receives, in interlocking engagement therein, a resiliently deformable fender member which projects outwardly of the outermost extent of the follower block to provide a surface portion which is maintained in confronting relationship with the respective adjacent surfaces of the center sill and yoke.

The cross-sectional form of the resilient fender member is suitably configured, with regard to the cross-sectional form of the cavity in which it resides, to provide clearance into which portions of the resilient member may deform under compressive loading whereby contact forces of sufficient magnitude between the resilient member and the sill sidewalls or yoke will force the outwardly projecting portion of the resilient member entirely into the cavity in which it resides whereby adjacent lateral side portions of the follower block itself will at an elevated transverse, force magnitude, make contact with the adjacent sill or yoke surfaces to thereby define the limits of lateral and vertical motion of the follower block and preclude or reduce wear between the follower block and the transversely adjacent components.

Most of the sliding friction between the follower block and adjacent components occurs at relatively low transverse force levels which are insufficient to bring the laterally or vertically disposed side surfaces of the follower block into frictional contact with the confronting center sill and yoke surfaces, due to the necessity that such lateral force components first overcome the bias of the resilient members by compressive deformation thereof. Since most of the relative longitudinal motion between the follower block and adjacent components occurs at such low transverse force levels, significant frictional wear conditions are eliminated or at most are limited to only a small terminal portion of each longitudinal motion cycle of the follower block when the transverse force components may be of sufficient magnitude to overcome the bias of the resilient member and bottom the respective follower block lateral or verical surface solidly on the confronting component surface. The resilient members thus serve to eliminate at least a major portion of the frictional sliding contact between follower block and adjacent components which has occurred in draft assemblies heretofore. Furthemore, to the extent that the resilient members may themselves be subject to such wear, they can be renewed by replacement thereof as needed to greatly extend the service life of both the follower block and the components against which it would wear in the absence of the resilient members.

It is therefore one object of the invention to provide a novel and improved method and apparatus for controlling lateral and vertical movement and impact of a draft gear follower block.

Another object of the invention is to provide a draft gear follower block with an envelope or range of cushioned lateral and vertical movement.

A more specific object of the invention is to provide a railway draft gear follower block with cushioning of lateral and vertical motion within a range of transverse load magnitudes from nil to a predeterminable force magnitude.

A more specific object of the invention is to provide a wear reducing elastomer interface between a follower block and transversely adjacent components of a draft assembly for reduced frictional sliding contact between the follower block and such transversely adjacent components throughout a major part of each cycle of relative longitudinal motion therebetween.

Yet another object of the invention is to provide a draft gear follower block with laterally and/or vertically disposed, resiliently deformable fender or bumper members which project outwardly of the transversely outermost extent of the follower block to provide first engagement, under transversely directed loads, with the confronting surfaces of adjacent components, the projecting portions of the bumpers being deformable under higher loads such that the transversely outermost portions of the rigid follower block engage the sill sidewall surfaces to limit the elastomer deformation and load to safe and non-destructive magnitudes.

A further object of the invention is to provide for the maintaining of a clearance between a follower block and transversely adjacent structural portion of a draft system throughout a range of transverse load magnitudes corresponding to the range of transverse load magnitudes during which substantially all relative longitudinal motion of the follower block occurs.

These and other objects and further advantages of the invention will be more readily appreciated upon consideration of the following detailed description and the accompanying drawings, in which:

FIG. 2 is a fragmentary side elevation of a follower block taken on line II—II of FIG. 1;

FIG. 3 is a sectional view taken on line III—III of FIG. 2;

FIG. 4 is an elevation from the vantage point of FIG. 3 showing an alternative cross-sectional configuration for the resilient fender of this invention and;

Figure 1:
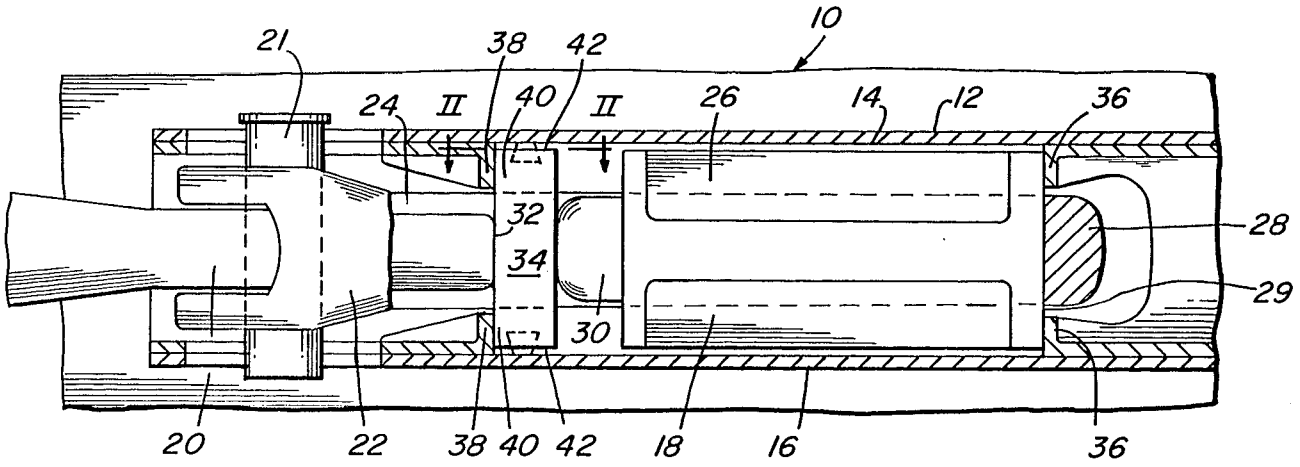
FIG. 1 is a partially sectioned plan view of a fragementary protion of a railway car draft system including the resilient fenders and other elements of the instant invention.

There is generally indicated at 10 in FIG. 1 a fragmentary portion of a rail car body having a sill structure 12 which includes sill sidewalls 14 and 16 and has components of the car coupling and draft system 18 disposed between the sidewalls 14 and 16. As is well known, the draft system 18 comprises a coupler having a shank portion 20 that is secured by means of a draft key 21 21 to a yoke 22. The yoke 22 is an elongated member with side portions 24 which join upper and lower portions 25 that pass over the top and bottom sides of a draft gear 26 and are joined in a rearward or inner end portion 28 which passes about the inner end of draft gear 26. Interposed intermediate a longitudinally movable piston portion 30 of draft gear 26 and a forward portion of yoke 22 is a coupler follower block 34.

As is well known, draft system 18 is effective to transmit both draft and buff loads imposed between the car coupling and the car body 10 by means of force transmitting elements including conventional cushioning elements in draft gear 26 (not shown) which thereby alleviate shock or impact loads by permitting a range of longitudinal motion between the coupler and the car body. Accordingly, in the buff mode, forces are transmitted via shank portion 20 via a surface 32 thereof which engages follower block 34, thence via follower block 34 to piston 30, through draft gear 26, and to rear stops 36 which are rigidly affixed with respect to center sill 12. Draft loads are transmitted via shank portion 20 and key 21 to yoke 22 and thence to the car body via the rearward end 28 of yoke 22 to draft draft 26, piston 30, follower block 34 and forward stops 38 which are also rigidly affixed with respect to center sill 12.

It will be understood that FIG. 1 is by intent a simplified not-to-scale schematic rendering of a railway vehicle draft arrangement wherein the relative proportions of various prior art components may appear to vary from actual design practice in the art. In particular, the illustrated proportionate length of the coupler shank and of the draft key slots may be perceived to differ from standard design pratice. These and other such variations are intended to simplify the disclosure of the invention, and to emphasize that the invention is not limited to use in heretofore known draft arrangements.

All of the above described elements and their operation are well known in the art. Accordingly, further detailed description thereof is believed unnecessary for an understanding of the present invention. Suffice it to note that the above-described modes of load transmission result in relative longitudinal movement of follower block 34 with respect to center sill sidewalls 14 and 16, and with respect to yoke 22, as above-described. Specifically, FIG. 1 shows the draft components in a neutral or non-loaded condition. Upon initiation of buff loading, the buff forces applied through follower block 34 move piston 30 to compress draft gear 18 in the well known manner whereby follower block 34 moves longitudinally with respect to sill sidewalls 14 and 16, and possibly also with respect to yoke 22, which bears no-buff loads whatever. In passing from a non-loaded condition to a draft condition, the draft forces applied through key 21, yoke 22 and draft gear 18 likewise impart relative motion between follower block 34 and yoke 22 in that, although follower block 34 is solid against forward stops 38, yoke 22 moves forward as draft gear 18 is compressed.

As has been noted hereinabove, every change in load magnitude which compresses the draft gear 18 or permits re-extension thereof results in relative movement between follower block 34 transversely adjacent structures. Accordingly, such relative motion occurs twice in moving from a buff loading condition to a draft loading condition, and four times in a complete cycle of buff loading to draft to buff again. As also has been noted, longitudinal misalignment, which is for all practical purposes unavoidable in railway vehicle draft systems, imposes transverse load components on the follower block which, when they result in contact of transverse side portions of the follower block with adjacent relatively movable structures, can result in significant wear through frictional rubbing of the relatively moving components. The present invention alleviates such wear and in other ways improves the wear characteristics of the follower block and adjacent components.

Referring more specifically to FIGS. 1, 2 and 3, follower block 34 comprises a rigid body of cast steel or the like having a pair of opposed lateral side portions 40 with respective lateral side surfaces 42 that confront the respective inwardly facing surfaces 44 of side walls 14 and 16, respectively. The configuration and operation of the resilient elements to be described, which are associated with each of the lateral side portions 40 of follower block 34, will be described only with respect to one lateral side of follower block 34 as shown in FIGS. 2 and 3. It will of course be understood that the structure and function of the other lateral side portion 40 is identical to the one described.

Lateral side portion 40 of follower block 34 has a formed, transversely or outwardly open groove or recess 46 extending longitudinally intermediate the ends thereof and configured to open toward the confronting surface portion 44 of sidewall 14. Recess 46, as shown, comprises a generally flat, longitudinally extending base portion 48 which is contiguous with respective spaced apart, longitudinally extending side portions 50 that converge toward the open side 49 of recess to form, in conjunction with base portion 48, a dovetail configuration having a relatively wider base 48 and a relatively narrower open side 49. The longitudinal ends of recess 46 are closed as at 47 to provide an abutment that limits endwise migration of a resilient fender member disposed therein. Specifically, a bumper or fender member 52 is received in recess 46 and is of a complementary cross-sectional form for interlocking engagement therewithin. Fender 52 is formed as an elongated, preferably unitary member of hard, resiliently deformable material such as cast polyurethane having a concave base portion 54 which extends longitudinally thereof intermediate respective spaced apart corner portions 56.

The exterior surface configuration of corner portions 56 is formed for complementary fit within the adjacent portions of recess base 48 and sidewalls 50 to provide for interlocking engagement of member 52 within recess 46. The portion of member 52 projecting outwardly from base 48 includes sidewall portions 58 which extend outwardly along respective sidewall portions 50 and contiguous, relieved sidewall portions 60 which project further outwardly of recess 46 in spaced relationship with respect to sidewalls 50. The outermost extremities of relieved sidewall portions 60 meet the laterally opposite extremities of an engagement surface portion 62 of member 52 which is disposed in confronting, forcefully engageable relationship with respect to sill sidewall surface 44. The surface 62 preferably extends the entire length of member 52 and is of a configuration, preferably flat, to conform with the surface profile of sidewall surface 44.

The member 52, as shown in FIG. 3 in its undeformed state, projects laterally outward of the lateral side surface 42 of follower block 34 such that transverse loadings on follower block 34 will first be supported by engagement of surface 62 with surface 44. The configuration of member 52 cooperates with recess 46 to provide voids such as at 64 and 66 to receive deformed portions of member 52 as transverse loadings applied to surface 62 deform the member 52 into recess 46. The entire resilient member 52 thus may be deformably compressed into the confines of recess 46 under sufficient transverse loadings to bring surface 42 of the follower block 34 into rigid engagement with sill sidewall surface 44. For example, the size, cross-sectional configuration, hardness, and resiliency characteristics of member 52 may be selected to provide for initiation rigid bearing contact between surfaces 42 and 44 at a transverse force level of approximately 10,000 pounds.

The result is that for transverse loads applied to the follower block, the block generally has available an initial range of free or unrestricted lateral movement before contact between surfaces 62 and 44, followed by a predetermined range of transverse loading (for example, substantially nil to 10,000 pounds) of cushioned lateral motion during which a clearance is maintained between the follower block and surface 44. For load magnitudes ranging upward from the prescribed upper limit of the transverse load range, one lateral side surface 42 of the follower block 34 will be in rigid bearing engagement with the respective sill surface 44. This defines the limit of lateral motion for follower block 34.

Of course, at any magnitude of transverse loading, the follower block 34 must move longitudinally in response to such changes in draft or buff loading as above described to perform its usual role in transmission of draft and buff loads between the car coupling and car body. However, a major part of all draft gear compression and re-extension motion occurs at relatively low levels of draft and buff loading. Accordingly, most of the relative longitudinal motion of follower block 34 with respect to adjacent portions of the sill sidewalls and the yoke occurs in load ranges where even the largest anticipated transverse load components on the follower block are insufficient to deform the member 52 into its recess. Therefore the vast majority if not all of the relative longitudinal motion under load between the follower block 34 and adjacent structures occurs as sliding contact between one of the members 52 and the transversely adjacent portions of the sill sidewalls or the yoke. This dramatically reduces galling and other modes of extreme wear which can otherwise result from frictional sliding engagement between the follower block and transversely adjacent components. In ranges of buff and draft loading where the transverse force components imposed on the follower block are sufficient to deform member 52 entirely into the confines of its respective recess the magnitude of relative longitudinal motion occurring between the follower block and adjacent structures is for all practical purposes nil.

In an alternative embodiment of the invention as shown in FIG. 4, the fender comprises an alongated member 52′ of resiliently deformable cast polyurethane, for example, and having a generally trapozoidal cross-sectional configuration comprising an outer longitudinally extending surface portion 62′ and an inner longitudinally extending surface portion 54′, and outwardly converging sidewall portions 60′. As shown, the sidewalls 60′ of the FIG. 4 embodiment are not relieved inwardly, nor is the concavity 54 of the FIG. 3 embodiment provided. Accordingly, portions of the receiving recess for member 52′ may be configured to provide suitable voids to receive inward deformation of bumper member 52′ into the receiving recess. To provide further for such inward deformation of member 52′ under compressive loading, corner portions of member 52′ may be truncated as at 56′ to provide an inwardly relieved surface and thereby create longitudinally extending voids in the respective lowermost corners of the receiving recess. The member 52′ thus may be utilized in a recess of a configuration such as recess 46, or in an alternative suitably configured recess.

Figure 5:
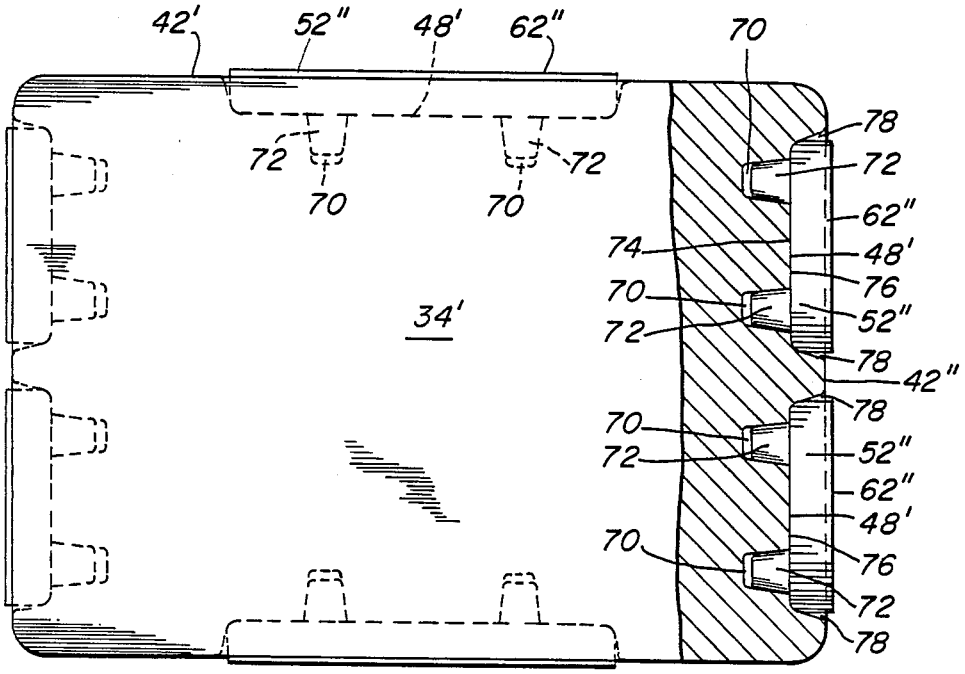
FIG. 5 is a partially sectioned front elevation of an alternative embodiment of the follower block of this invention.

Still another embodiment of the fender member of this invention is shown in FIG. 5 as a follower block 34′ having disposed within recesses 48′ about the transverse perimeter thereof a plurality of fender members 52″ which function in a manner entirely similar to that above described. Most particularly, each member 52″ includes an outermost surface portion 62″ which projects outwardly of the outermost transverse extent of follower block 34′.

Rather than utilizing the key or dovetail configuration of the above-described embodiments, recesses 48′ may be provided with portions such as generally conical blind bores 70 which receive complementary post portions 72 of members 52″ to retain members 52″ within the respective recesses 48′. Preferably, each bore 70 is of greater axial length than post portions 72 whereby the engagement of an inner surface 74 of each member 52″ with a cooperating surface portion 76 of each respective recess 48′ determines the fully seated condition of the members 52″.

The sidewall portions 78 of recesses 48′ may diverge outwardly as shown to provide clearance to receive deformed portions of members 52″ upon compressive loading thereof. Thus, as with the above-described embodiments, members 52″ may be deformed into the confines of the respective recesses 48′ until the respective transversely outermost surface portion 42′ of the follower block comes into abutting engagement with the respective transversely adjacent structure.

A further aspect of the invention shown in FIG. 5 and applicable to any embodiment described hereinabove is that a follower block 34′ may be provided with resilient members on the laterally opposed surface portions thereof, the vertically opposed surface portions, or both. In addition, the resilient member carried by any transversely oriented surface portion of a follower block may be comprised of a single resilient element as shown for the above-described embodiments or the vertically disposed surfaces of the follower block in FIG. 5, or a plurality of such resilient members as shown for the laterally disposed surfaces of the follower block in FIG. 5.

Of course it will be appreciated that the above description of the structure and operation of the present invention also constitutes disclosure of the novel method of this invention. The method pertains to novel steps in managing and controlling lateral and longitudinal movement of a draft gear follower block under the influence of transverse loading as above described limit frictional wear between the follower block and transversely adjacent elements by limiting direct engagement therebetween to those portions of the draft gear operating cycle in which relative longitudinal motion between the follower block and such adjacent elements is minimal. This is accomplished by resisting tranverse movement of the follower block with a transversely directed resisting force (evolved by compressive deformation of the resilient fender) which increases in magnitude with decreasing clearance between the follower block and transversely adjacent components of the draft system. The resisting force maintains the desired clearance between the follower block and the transversely adjacent components substantially throughout relative longitudinal motion therebetween due to coordination of the fender elastic modulus properties and geometry with the response characteristics of the draft gear such that transverse force components of sufficient magnitude to bring the follower block into direct engagement with the transversely adjacent structures occur only with longitudial buff or draft loads of sufficient magnitude to fully compress the draft gear.

According to the description hereinabove, there is provided by the instant invention a novel and improved method and apparatus for management of lateral and longitudinal motion of a follower block in a railway car coupler and draft system. The above described embodiments set forth certain presently preferred embodiments of the invention, including the presently contemplated best mode thereof, and are merely exemplary in nature. I have contemplated other alternative and modified embodiments and such certainly would also occur to others versed in the art once apprised of my invention. It is therefore my intent that the invention be construed broadly and limited only by the scope of the claims appended hereto.

I claim:

1. In a railway vehicle coupling system which includes a draft assembly disposed within a housing carried by a railway vehicle, a follower block means comprising:

a follower block which is longitudinally movable with respect to elongated, transversely adjacent surface portions of such a coupling system;

said follower block including a rigid body member adapted to be disposed within such a housing in buff and draft load transmitting cooperation with other elements of such a draft assembly;

said body member having thereon outer bearing portions which are adapted to be disposed in spaced confronting relationship with such surface portions, respectively;

resiliently deformable means carried by said follower block and extending therefrom adjacent said outer bearing portions for engagement with such transversely adjacent surface portions respectively; and retention means for retaining said resiliently deformable means with respect to the respective said outer bearing portions such that each said resiliently deformable means is engageable with such transversely adjacent surface portions, respectively, and is deformable under transversely directed loads applied to said body member in a manner to permit said body member to engage such transversely adjacent surface portions only when such transversely directed loads exceed a predetermined maximum magnitude.

2. The follower block means as claimed in claim 1 wherein said resiliently deformable means is of such geometry and elastic characteristics, and is cooperable with said retention means in a manner that such engagement between said body member and such transversely adjacent surface portions occurs substantially without simultaneous relative longitudinal motion between said follower block and such transversely adjacent surface portions.

3. The follower block means as claimed in claim 2 wherein said retention means includes elongated recess means formed in said body member adjacent said outer bearing portions to receive the respective said resiliently deformable means.

4. The follower block means as claimed in claim 3 wherein each said resiliently deformable means includes an elongated body of elastomeric material.

5. The follower block means as claimed in claim 4 wherein each said body of elastomeric material is formed for cooperation with the respective said recess means to permit compressive deformation of each said body of elastomeric material at least partially into the confines of the respective said recess means under such transversely directed loads.

6. The follower block means as claimed in claim 5 wherein said recess means includes a plurality of elongated dovetail key slots.

7. The follower block means as claimed in claim 6 wherein each said body of elastomeric material includes a longitudinally extending relieved portion disposed to reside adjacent the base of the respective said dovetail key slot.

8. The follower block means as claimed in claim 5 wherein said retention means includes bore means located in the base of each said recess means and projecting therefrom into said body member, and each said body of elastomeric material includes retention post means formed to be cooperably interfitted within said bore means, respectively.

9. In a railway vehicle draft system for connecting a pair of adjacent railway cars to transmit longitudinally directed buff and draft loads therebetween wherein a follower block is movable longitudinally and transversely with respect to transversely adjacent, longitudinally extending surface portions of said draft system, the method of reducing wear in such a draft system comprising the steps of:

providing a lateral clearance between the follower block and the laterally adjacent said surface portions by resisting transverse movement of the follower block toward the respective said surface portions with an opposed transversely directed force of a magnitude which increases with decreasing magnitude of the clearance between said follower block and the respective surface portions with the clearance between the follower block and the respective surface portions being maintained substantially throughout relative longitudinal motion therebetween; and permitting the follower block to engage the respective such surface portions only when there is substantially no relative longitudinal motion therebetween.

10. The method as claimed in claim 9 including the further step of limiting said resilient biasing to a predetermined maximum magnitude of biasing.

11. The method as claimed in claim 9 wherein such clearance is maintained by maintaining and element in resilient engagement with said follower block and with the respective said surface portions for resiliently biasing the follower block away from such surface portions throughout movement of the follower block through a preselected transverse distance prior to engagement of the follower block with such surface portions.

12. A draft assembly for connecting a pair of adjacent railway cars comprising:

a formed housing having a first pair of elongated, laterally spaced surface portions;

a draft gear carried by said housing intermediate said surface portions and movably supported thereby for axial movement with respect to said laterally spaced surface portions;

a coupler member having a shank portion extending axially of said housing intermediate said laterally spaced surface portions with a free end thereof being spaced longitudinally from one longitudinal end of said draft gear;

a follower block located longitudinally intermediate said free end and said one longitudinal end and engageable thereby;

a connecting means connected to said shank portion and cooperable with the other longitudinal end of said draft gear for maintaining said draft gear in engagement with said follower block during movement of said shank portion away from said follower block;

said connecting means including a second pair of elongated, laterally spaced surface portions which are generally longitudinally coextensive with said first pair of laterally spaced surface portions;

said follower block having outer portions located adjacent at least some of said laterally spaced surface portions, respectively;

resilient means carried by said outer portions of said follower block and extending outwardly therefrom and engageable with said laterally spaced surface portions, respectively, to bias said follower block laterally away from said surface portions; and ones of said resilient means being deformable in response to movement of said follower block through a preselected magnitude of lateral movement toward the respective said surface portions.

13. The draft assembly as set forth in claim 12 wherein said at least some of said laterally spaced surface portions includes either of said first pair of laterally spaced surface portions.

14. The draft assembly as set forth in claim 12 wherein said at least some of said laterally spaced surface portions includes either of said second pair of laterally spaced surface portions.

* * * * *